US005814160A

United States Patent [19]

Orlando

[11] Patent Number: 5,814,160

[45] Date of Patent: Sep. 29, 1998

[54] METHOD AND APPARATUS FOR MAINTAINING CLEAN TUBING

[75] Inventor: Michael A. Orlando, Westminster, Calif.

[73] Assignee: McDonnell Douglas Corp., Long Beach, Calif.

[21] Appl. No.: 756,367

[22] Filed: Nov. 26, 1996

[51] Int. Cl.[6] ..... B08B 9/00; B08B 9/02

[52] U.S. Cl. ..... 134/8; 134/22.1; 134/22.11; 134/22.14; 15/104.05; 15/104.067

[58] Field of Search ..... 134/8, 22.1, 22.11, 134/22.14; 15/104.05, 104.067

[56] References Cited

U.S. PATENT DOCUMENTS

| | | | |
|---|---|---|---|
| 2,906,650 | 9/1959 | Wheaton | 134/8 |
| 3,713,263 | 1/1973 | Mullen | 52/403 |
| 3,895,146 | 7/1975 | Nishimaki et al. | 428/56 |
| 5,364,473 | 11/1994 | Van Der Does | 134/8 |

*Primary Examiner*—Marian C. Knode
*Assistant Examiner*—Brenda G. Brumback
*Attorney, Agent, or Firm*—Donald E. Stout

[57] ABSTRACT

A cleaning plug for cleaning and preventing contamination from entering the interior of a piece of tubing. The cleaning plug is compressible such that it may be compressed to a size smaller than the interior of the tubing and inserted into the tubing without abrading or otherwise leaving contamination on the interior walls of the tubing. The cleaning plug is then allowed to expand such that it contacts and forms a seal with the interior wall of the tubing. The cleaning plug is made from a material which is nonabrasive, non-contaminating and nonreactive with liquids to be passed through the tubing. When used for preventing contamination from entering the tubing, the cleaning plug is inserted adjacent to the opening of the tubing. When used for cleaning, the cleaning plug is inserted into the tubing and moved longitudinally along the inside of the tubing to mechanically remove any contamination.

20 Claims, 1 Drawing Sheet

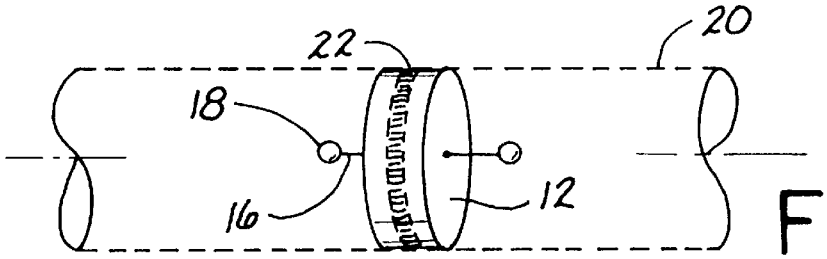
FIG. 1
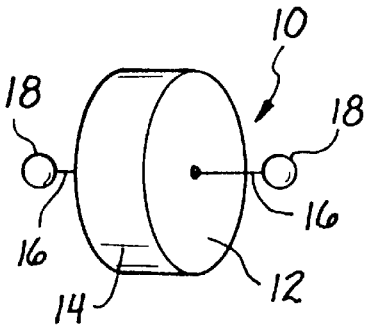
FIG. 2
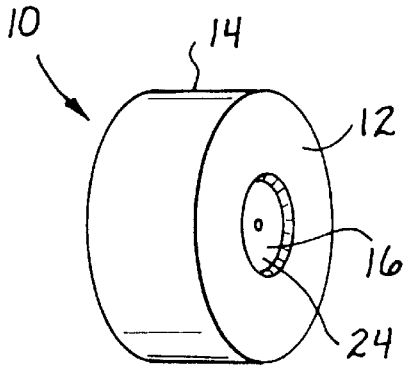
FIG. 3
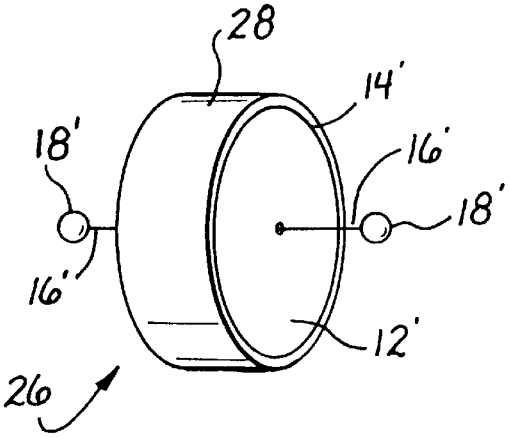
FIG. 4
FIG. 5
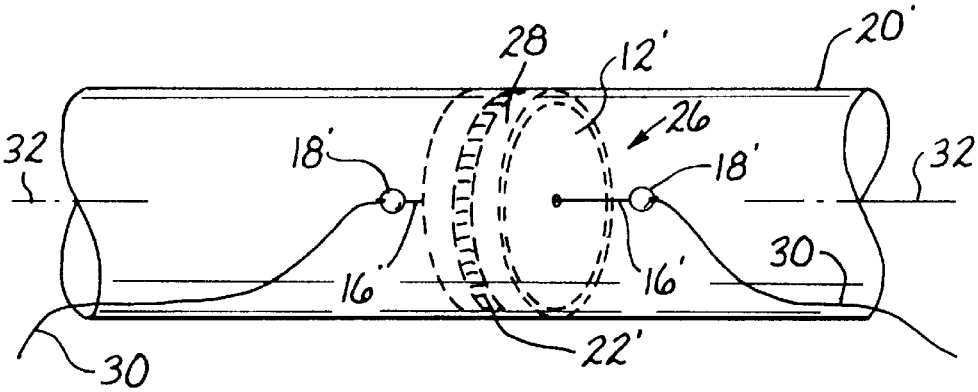

METHOD AND APPARATUS FOR MAINTAINING CLEAN TUBING

FIELD OF THE INVENTION

This invention relates generally to maintaining clean tubing and more particularly, to a method and apparatus for cleaning and preventing contamination from entering a section of tubing.

BACKGROUND OF THE INVENTION

When preparing sections of tubing for certain types of welding and manufacturing operations, proper cleanliness and contamination control are often critical. For these types of operations, contamination control generally includes providing a precision cleaned piece of tubing as well as preventing any outside contamination from entering the tubing during the manufacturing and assembly process. Typical welding and manufacturing operations that require such precision cleanliness include, for example, aircraft manufacture.

Contamination in tubing pieces and sections can generally be separated into two types. The first type, particulate contamination, includes metal chips as well as other pieces of material which are left within the interior of the tubing. Particulate contamination commonly occurs when cutting tubing or when the inside the tubing is abraded. The second type of contamination, often called molecular contamination, includes oils and greases left remaining on the interior of the tubing. Both types of contamination are undesirable and may even have catastrophic consequences. For instance, contamination left in tubing can lead to clogged filters, worn parts, among many other problems. In other more specific applications, contamination left in tubing used for transporting liquid oxygen or other fuel substances can lead to fires or even explosions.

Modern welding and assembly techniques, including the use of orbital tube welders and trim on assembly techniques have increased the need for precision cleaned tubing. For example, the efficient use of orbital tube welders requires that the tubing pieces to be joined are generally cut to fit with minor excess. Just prior to final assembly and the weld operation, each tubing piece is trimmed to a precision fit as required by the orbital tube welding operation. During this final trimming operation, particles can be left in the interior of the tubing sections causing contamination. Thus, there is a need for apparatus and method for preventing the inclusion of contamination within the interior of tubing sections.

In conjunction with welding operations, assembly of the tubing pieces often requires substantial human and mechanical handling. This handling can lead to abrasions as well as the inclusion of oils and grease into the interior of the tubing, also causing contamination. Thus, there is also a need for an apparatus and method for preventing the inclusion of contamination due to handling during assembly.

In addition to preventing contamination from entering the open and trimmed ends, the tubing may require precision cleaning. Any apparatus or method for cleaning such tubing must not leave residue or abrasions which lead to additional particles in the tubing. The apparatus must also be compatible with liquid oxygen, liquid nitrogen and any other media to be utilized within the tubing. Thus, there is a need for an apparatus and method for cleaning the interior of tubing sections which doesn't cause abrasions or additional contamination within the tubing and is compatible with all types of fuel or other media which may be used.

For the foregoing reasons, there is a need for an apparatus and method which prevents contamination of the interior of tubing pieces during manufacturing and assembly operations. The apparatus and method should be compatible with liquid oxygen, liquid nitrogen and any other fuel media which may be carried in the tubing sections. The apparatus and method should also be simple to use and inexpensive to manufacture.

SUMMARY

The present invention satisfies the need for an apparatus and method of preventing contamination from entering the interior of a piece of tubing by providing a cleaning plug which is insertible into an open end of a piece of tubing to prevent the entrance of contamination into the tubing and beyond the cleaning plug. The cleaning plug of the present invention also satisfies the need for an apparatus and method of maintaining clean tubing without further contaminating the tubing by providing a cleaning plug made from a simple and readily available material which is compatible with most substances carried by the tubing.

The present invention additionally satisfies the need for an apparatus and method of cleaning a piece of tubing by providing a cleaning plug which is insertible into the open end of a piece of tubing, contacts the inner wall of the tubing and is moveable along the longitudinal axis of the tubing to remove contamination.

In general, a cleaning plug having the features of the present invention includes a compressible portion and outer portion having an outer wall bounding the compressible portion. The overall size of the cleaning plug is larger or has a greater outer diameter than the inner diameter of the tubing to be cleaned or otherwise kept contamination free. Thus, the outer wall of the cleaning plug contacts and maintains a seal against the inner wall of the tubing to prevent contamination from passing across the seal. In addition, the cleaning plug can be moved longitudinally within the tubing to clean the inner wall. The compressible portion allows the cleaning plug to be compressed to a size smaller than the open end of the tubing. The compressible portion is generally made from a material which expands sufficiently slowly such that the cleaning plug can be inserted into the tubing without contacting the inner walls.

In one broad aspect of the present invention, the cleaning plug comprises a compressible portion which is made from a foam having a slow recovery period such that when the cleaning plug is compressed it expands to its original size sufficiently slowly to enable the plug to be inserted into the tubing without contacting the interior of the tubing as previously described.

In another broad aspect of the present invention, the cleaning plug comprises a compressible portion and an outer wall which are both made from the aforementioned foam material, and, in particular, a polyurethane foam. The polyurethane foam has a slow recovery period as described above.

In another broad aspect of the present invention, the cleaning plug includes a grasping member which is connected to the compressible portion of the cleaning plug. The grasping member includes an enlarged portion on each side of the cleaning plug to facilitate handling and the removal of the cleaning plug from the piece of tubing.

In yet another aspect of the present invention, the cleaning plug includes a sleeve which covers the exterior of the outer wall. This sleeve is designed to be the contact surface against the interior wall of the tubing. In one application, the sleeve may be saturated with a solvent for cleaning the interior of the tubing or alternatively, used dry to increase the life of the cleaning plug itself. The sleeve may be made from a material which is generally compatible and nonreactive with liquid oxygen, fuels and other media which may be carried by the tubing.

According to a method of the present invention, a cleaning plug having features of the present invention is used to prevent contamination from entering an open end of a piece of tubing. In this method, the cleaning plug is compressed such that it may be inserted into the piece of tubing without contacting the inner wall of the tubing. The compressed cleaning plug is then inserted into the tubing and allowed to expand such that the cleaning plug contacts and exerts pressure on the interior wall of the piece of tubing. The cleaning plug seals the interior of the tubing. After final handling and manufacturing operations, the cleaning plug may be removed from the interior of the piece of tube.

In another broad aspect of the present invention, the method comprises cleaning the interior of a piece of tubing by compressing a cleaning plug having a compressible and expandable outer wall such that the cleaning plug is smaller in diameter than the interior of the piece of tubing. The compressed cleaning plug is then inserted into the piece of tubing. The outer wall is allowed to expand until it contacts the interior wall of the piece of tubing. The cleaning plug is then moved inside the piece of tubing across the length to be cleaned. After the cleaning plug has been sufficiently moved across the interior wall of a section of tubing, the cleaning plug is removed. In yet another broad aspect of the present invention, the method includes applying a cleaning solvent to the cleaning plug prior to insertion into the piece of tubing.

The foregoing and additional advantages of the invention together with the structure and method characterized thereof, which was only summarized in the foregoing passages, will become more apparent to those skilled in the art upon reading the detailed description of the preferred embodiments of the invention, which follows in the specification, taken together with the drawings hereof presented herein.

BRIEF DESCRIPTION OF THE DRAWINGS

FIG. 1 is a perspective view of an embodiment of a cleaning plug having features of the present invention shown inside a piece of tubing;

FIG. 2 is a perspective view of the cleaning plug as shown in FIG. 1;

FIG. 3 is a perspective view of a second embodiment of a cleaning plug of the present invention having a grasping member;

FIG. 4 is a perspective view of a third embodiment of a cleaning plug of the present invention having an outer sleeve; and FIG. 5 is a perspective view of a piece of tubing showing the cleaning plug of FIG. 4 inserted therein.

BRIEF DESCRIPTION OF THE DRAWINGS

Referring to FIGS. 1 and 2 a cleaning plug assembly for use with a section or piece of tubing and having the features of the present invention is shown. The cleaning plug assembly 10 generally includes a compressible portion 12 and an outer wall 14. The cleaning plug assembly 10 may also include a grasping member 16 extending from either side of the compressible portion 12. The grasping member 16 may preferably include an enlarged portion 18 to facilitate handling of the cleaning plug assembly 10. In a preferred embodiment of the invention, the enlarged portion 18 may comprise a looped end.

Referring now in particular to FIG. 1, cleaning plug assembly 10 is shown installed in a typical piece of tubing 20. The tubing 20 may be of a round cross-section as shown or may comprise a square cross-section or any other cross-section as is commonly used in industry. Such tubing, may for example, include precision tubing used to carry fuel and other media in vehicles and aircraft. Thus, the cleaning plug assembly 10 may be used to clean and to prevent contamination from entering any tubing, piping or other enclosed conduit.

The cleaning plug assembly 10 is preferably made from a material which is compatible with the materials which will be transported within the final tubing assembly. In particular, the outer wall 14 of the cleaning plug assembly 10 must be compatible and nonreactive with these materials. In certain applications, these materials may include liquid oxygen, liquid nitrogen, hydrazone, and any other engine fuel media. Compatibility with these media types, particularly in aircraft applications, is essential since any contamination remaining in the tubing may react and have severe consequences.

The cleaning plug assembly 10 is preferably constructed such that the outer wall 14 is larger in size than the inside or interior cross-section of the tubing 20. For round tubing, this means that the outer wall 14 would have a greater diameter than the inner diameter of the piece of tubing 20. In this way, the outer wall 14 of the cleaning plug assembly 10 makes a continuous contact along the inside wall or interior of the piece of tubing 20 to create a seal 22.

The outer wall 14 is preferably made from a smooth, non-abrasive material such that it does not scratch or otherwise abrade the piece of tubing 20. This prevents particles or contamination from being generated by the cleaning plug assembly 10 when contacting the interior wall of the tubing 20. Additionally, the outer wall 14 preferably has a generally continuous and smooth surface such that the seal 22 between the interior wall of the piece of tubing 20 on the outer wall 14 is continuous and prevents contamination from being able to pass across the seal 22. The outer wall 14 should also leave no residues or molecular contamination on the interior wall of the piece of tubing 20.

The compressible portion 12 is preferably made from a material which can be compressed and naturally expands back to its original configuration. The material may be a foam and preferably a foam having a slow recovery period. This allows the cleaning plug assembly 10 to be compressed and to naturally expand back to its original configuration. The slow recovery allows for a slow expansion which yields sufficient time to insert the cleaning assembly plug 10 into the interior of the piece of tubing 20 without contacting the interior wall of the piece of tubing 20. This allows insertion without the possibility of abrasions or additional contamination. The compressible portion 12 may preferably be made from a polyurethane foam having a slow recovery period such as the polyurethane foam supplied by Expanded Rubber Products, Inc. of Gardenia, Calif., product number C47. However, other foams and compressible and elastic materials having the desired properties described herein may also be satisfactory.

In a preferred embodiment, the cleaning plug assembly 10 comprises a compressible portion 12 and an outer wall 14 as a continuous piece of polyurethane foam having a slow recovery. This embodiment allows the cleaning plug assembly 10 to be compressed uniformly. This, in turn, simplifies insertion into the piece of tubing 20. By uniformly compressing the cleaning plug assembly 10 there is less chance of abrasion, contamination or contact with the inner wall of the piece of tubing 20. In addition, the cleaning plug assembly 10 expands in a generally uniform pattern. This uniform expansion allows for uniform contact of the outer wall 14 with the inner wall of the piece of tubing 20 and provides for an even seal 22.

The grasping member 16 may include an elongated member such as a piece of wire which is passed through the compressible portion 12. The grasping member 16 is then fitted with an enlarged portion 18 on either side of the cleaning plug assembly 10 at each end of the grasping member 16. The enlarged portion 18 prevents the pulling through of the grasping member 16 from the cleaning plug assembly 10 as well as providing for a handling location. The grasping member 16 is generally used to facilitate insertion and removal of the cleaning plug assembly 10 from the piece of tubing 20. In a preferred embodiment of the invention, the elongated member of the grasping member 16 may be a wire and the enlarged portion 18 may be a looped end of the wire. The grasping member 16 may also be made from any other form of wire, rope, thread, plastic or the like which can be used for insertion and removal of the cleaning plug assembly 10. However, any material including a grasping member 16 must be nonabrasive, leave no contamination and be compatible with all materials to be passed through the piece of tubing 20 including fuel media and liquid oxygen.

Referring now to FIG. 3, a modified embodiment of the cleaning plug assembly 10*a* is shown, wherein like elements to those illustrated in FIG. 2 are designated by like reference numerals, followed by the letter "a". In this embodiment, the cleaning plug assembly 10*a*includes a grasping member 16*a* having the configuration of a grip disk 24. The grip disk 24 is preferably centrally located in the cleaning plug assembly 10*a*. This allows for simple insertion and removal of the cleaning plug assembly 10*a* from the piece of tubing 20*a*. The grip disk 24 may be fitted with an indentation or a slot to facilitate handling. Alternatively, the grip disk 24 may have an outward protrusion, be hollow through its center or be fitted with any other means of providing a gripping or handling surface.

The grip disk 24 may be made from a soft plastic around which the compressible portion 12*a* is fitted. However, the grip disk 24 may also be made from any material which does not abrade or leave contamination on the interior of the piece of tubing 20.

In another alternative configuration, the cleaning plug assembly 10*a* may be configured without a grasping member 16*a*. In this configuration, the compressible portion 12*a* may be grasped to facilitate insertion of the cleaning plug assembly 10*a* into and out of the piece of tubing 20. Alternatively, dry compressed air or other non-contaminating fluid media may be expanding in the tubing 20 to remove the cleaning plug assembly 10*a*.

Referring now to FIGS. 4 and 5, a third alternative embodiment of the cleaning plug assembly having features of the present invention is shown, wherein like elements to those illustrated in FIGS. 1 and 2 are designated by like reference numerals followed by the letter "b". In this enbodiment, the cleaning plug assembly 26 includes a compressible portion 12*b*, an outer wall 14*b* and a grasping member 16*b*. An outer sleeve 28 covers the outer wall 14*b*. In this embodiment, the outer sleeve 28 contacts the interior wall of the piece of tubing 20*b*. The outer sleeve 28 may be made from any material, natural or synthetic, which does not abrade the interior wall of the tubing and which does not leave any contamination residue, either molecular or particulate.

In a preferred embodiment, the outer sleeve 28 is a clean cloth material and more preferably a clean cloth material having the ability to absorb and retain a cleaning solvent.

Referring now in particular to FIG. 5, the cleaning plug assembly 28 is shown inside a piece of tubing 20*b*. The outer sleeve 28 contacts the interior wall of the piece of tubing 20*b* to form a seal 22*b*. In this configuration, the cleaning plug assembly 26 may be used as a contamination shield to prevent contamination from passing across the seal 22*b* or, alternatively, may be used as a cleaning member.

Referring now back to FIGS. 1 and 2, a method of using the cleaning plug assembly 10 to prevent contamination from entering the piece of tubing 20 will be described. In general, the cleaning plug assembly 10 is compressed such that it may be inserted into the piece of tubing 20 without contacting the interior wall of the tubing 20. The cleaning plug assembly 10 is then inserted into the tubing 20. Gloves or other protection may be used to prevent contamination of the cleaning plug assembly 10. If the interior wall of the tubing 20 is touched, this may be of no concern depending on the material to be carried by the tubing 20. Thus, the step of compressing the cleaning plug assembly 10 may be deleted where there is no concern about contamination from the cleaning plug assembly 10 itself or if the contamination can be cleaned by other means.

The cleaning plug assembly 10 is then allowed to expand such that the outer wall 14 contacts and exerts pressure on the interior wall of the tubing 20 creating a seal 22. The cleaning plug assembly 10 is now inserted into the piece of tubing 20 and contamination is prevented from passing across the seal 22.

Prior to final assembly or welding, the cleaning plug assembly 10 is removed from the piece of tubing 20. This is preferably accomplished by pulling on the grasping member 16. However other methods of removing the cleaning plug assembly may include drawing a vacuum on the tubing 20, blowing compressed air or other compressed fluid against the cleaning plug 10 through the tubing 20 or any other method to remove the cleaning plug 10 without abrading or leaving contamination on the interior of the tubing 20.

In general, for the prevention of contamination across the seal 22, the cleaning plug 10 may be inserted just past an open end in the piece of tubing 20. This prevents contamination from entering the majority and possibly the entirety of the piece of tubing 20. Also, removal of the cleaning plug 10 is simplified and any contamination at the open end of the tubing 20 is swept out with removal of the cleaning plug assembly 10.

In addition to preventing contamination from entering the piece of tubing 20, the cleaning plug assembly 10 of the present invention may also be used to precision clean the interior wall of the piece of tubing 20. For cleaning, use of a cleaning plug described in the present invention and having an outer sleeve is preferred. However, a cleaning plug assembly such as the cleaning plug assembly of the present invention without an outer sleeve may also be satisfactory.

Referring now again to FIG. 5, the cleaning plug assembly 26 may be used to clean the inner wall of sections of tubing, such as the piece of tubing 20*b*. In this method, the cleaning plug assembly 26 is inserted into an open end of the tubing 25. However, to facilitate the cleaning and required movement of the cleaning plug 26 within the tubing 20*b*, stands of string or threads 30 may be provided on either side of the cleaning plug assembly 26. In a preferred embodiment, a single thread 30 may be attached to each of the enlarged portions 18*b* of the grasping member 16*b*. The threads 30 may be flexible threads made from a man made or synthetic fiber, or solid members either of which are nonabrasive, non-contaminating and nonreactive with any material which may pass through the tubing 20*b*. In a preferred embodiment, the threads 30 are clean cloth threads.

After a first thread 30 is passed through the entire length of the piece of tubing 20*b*, the cleaning plug assembly 26 may be inserted into an open end of the tubing 20*b*. Insertion of the cleaning plug assembly 26 may include compressing the cleaning plug assembly 26 as previously described. The cleaning plug assembly 26 is allowed to expand until the outer wall 14*b* and the outer sleeve 28 contact the interior wall of the piece of tubing 20*b*. The cleaning plug assembly 26 is then moved along a longitudinal axis 32 of the tubing 20*b*. This movement is accomplished using each of the threads 30, which are individually pulled one at a time to move. This action moves the cleaning plug assembly 26 back and forth inside the tubing 20*b*. After sufficient cleaning, the cleaning plug assembly 26 may then be removed from the tubing 20*b*.

In a preferred method, a cleaning solvent may be applied to the outer sleeve 28 prior to insertion of the cleaning plug assembly 26 into the tubing 20*b*. The cleaning solution may preferably be nonabrasive, non-contaminating and nonreactive with any fluid which will later pass through the tubing.

While this invention has been described with respect to various specific examples and embodiments, it is to be understood that the invention is not limited thereto and that it can be variously practiced within the scope of the following claims.

What is claimed is:

1. A cleaning plug for maintaining a piece of tubing clean during a manufacturing and handling operations having a longitudinal axis and an inner diameter, said cleaning plug comprising:

a compressible portion having an outer wall of sufficient diameter for contacting and maintaining a seal along said tubing inner diameter and for preventing contamination from passing across said seal, said compressible portion made from an expandable foam having a slow recovery period such that when compressed, said compressible portion naturally expands back to an original configuration;

a grasping member coupled to the compressible portion and adapted to facilitate the insertion and removal of the compressible portion into the piece of tubing; and wherein said compressible portion is compressible to a diameter smaller than said tubing inner diameter and expands sufficiently slowly such that the cleaning plug is insertable into the piece of tubing without contacting said tubing inner diameter.

2. The cleaning plug as recited in claim 1 wherein the compressible portion comprises a polyurethane foam.

3. The cleaning plug as recited in claim 1 wherein the outer wall is compatible and non-reactive with liquid oxygen.

4. The cleaning plug as recited in claim 1 wherein the outer wall is compatible and non-reactive with liquid nitrogen.

5. The cleaning plug as recited in claim 1 wherein the outer wall is compatible and non-reactive with engine fuel media.

6. The cleaning plug as recited in claim 1 wherein said grasping member comprises a grip disk which is centrally coupled to said compressible portion.

7. The cleaning plug as recited in claim 1 and further comprising an outer sleeve for covering the outer wall and for contacting said inner diameter of said piece of tubing.

8. The cleaning plug as recited in claim 7 wherein the sleeve comprises a material which is non-contaminating to any fluids to be passed through the piece of tubing.

9. A method of maintaining a piece of tubing clean during manufacturing and handling operations using a cleaning plug comprising the steps of:

providing a cleaning plug having a compressible inner portion with an outer wall for contacting an interior portion of the piece of tubing and a centrally coupled grasping member for handling the cleaning plug, said compressible portion being made from an expandable foam having a slow recovery rate;

compressing the cleaning plug such that the cleaning plug is insertable into an open end of said piece of tubing without contacting the interior of the piece of tubing;

inserting the compressed cleaning plug into the open end of said piece of tubing prior to said manufacturing and handling operations;

allowing the cleaning plug to expand such that the cleaning plug contacts and exerts pressure on said interior of the piece of tubing adjacent said open end; and removing the cleaning plug from the interior of the piece of tubing tube after completion of said manufacturing and handling operations.

10. A method of maintaining a piece of tubing clean during manufacturing and handling operations as recited in claim 14 wherein the step of inserting the cleaning plug comprises inserting the cleaning plug to a location just inside an open end of said piece of tubing.

11. The cleaning plug as recited in claim 1 wherein said grasping member comprises an elongated member extending through the center of said compressible portion and generally parallel to said longitudinal axis, said elongate member having a pair of opposing ends, each end having an enlarged portion to prevent said elongate member from pulling through said compressible portion and to facilitate handling of said cleaning plug in said piece of tubing.

12. The cleaning plug as recited in claim 11 wherein said elongated member comprises a wire and wherein each of said enlarged portions comprises a looped end of said wire.

13. The cleaning plug as recited in claim 6 wherein said grip disk comprises at least one plastic disk having an open and hollow center.

14. The method of maintaining a piece of tubing clean as recited in claim 9 and further comprising the step of moving the cleaning plug longitudinally within the piece of tubing such that the outer wall contacts the interior of the piece of tubing to mechanically remove any contamination.

15. The method of maintaining a piece of tubing clean as recited in claim 14 wherein the step of moving the cleaning plug comprises moving the cleaning plug back and forth along the longitudinal axis of the piece of tubing.

16. The method of maintaining a piece of tubing clean as recited in claim 15 wherein the step of moving the cleaning plug comprises alternatively pulling one of a pair of opposing threads, each thread attached to an opposite end of the grasping member and extending through an opposing open end of the piece of tubing.

17. The method of maintaining a piece of tubing clean as recited in claim 9 and further comprising the step of installing a non-abrasive outer sleeve on the outer wall prior to the step of inserting the cleaning plug into the open end of the piece of tubing.

18. The method of maintaining a piece of tubing clean as recited in claim 17 and further comprising the step of applying a solvent to the outer sleeve prior to the step of inserting the cleaning plug into the open end of the piece of tubing.

19. A cleaning plug for precision cleaning a section of tubing having a longitudinal axis and an inner diameter, said cleaning plug comprising:

a compressible portion having an outer wall, said compressible portion made from a compressible and naturally expandable polyurethane foam having a slow recovery period;

an outer sleeve removably mounted over said outer wall, said outer sleeve for contacting and moving along the inner diameter of said section of tubing; and an elongated grasping member passing through the compressible portion and being generally parallel to the longitudinal axis, said grasping member having at least one enlarged portion adapted for connection with a thread.

20. The cleaning plug as recited in claim 19 wherein the outer sleeve comprises a clean cloth material.

* * * * *